US007145414B2

(12) United States Patent
Okamoto et al.

(10) Patent No.: US 7,145,414 B2
(45) Date of Patent: Dec. 5, 2006

(54) TRANSMISSION LINE ORIENTATION TRANSITION

(75) Inventors: Douglas Seiji Okamoto, South San Francisco, CA (US); Anthony C. Sweeney, Salem, NH (US); Thomas M. Gaudette, Boston, MA (US)

(73) Assignee: Endwave Corporation, San Jose, CA (US)

( * ) Notice: Subject to any disclaimer, the term of this patent is extended or adjusted under 35 U.S.C. 154(b) by 83 days.

(21) Appl. No.: 10/883,401

(22) Filed: Jun. 30, 2004

(65) Prior Publication Data

US 2005/0030120 A1 Feb. 10, 2005

Related U.S. Application Data

(60) Provisional application No. 60/484,128, filed on Jun. 30, 2003.

(51) Int. Cl.
*H03H 7/38* (2006.01)

(52) U.S. Cl. ..... 333/34; 333/246

(58) Field of Classification Search ..... 333/243–246, 333/32–35, 253, 254, 260, 21 R
See application file for complete search history.

(56) References Cited

U.S. PATENT DOCUMENTS

| | | | | |
|---|---|---|---|---|
| 2,428,831 | A | 10/1947 | Brown et al. | |
| 2,812,501 | A | 11/1957 | Sommers | |
| 2,992,407 | A | 7/1961 | Slusher | |
| 3,505,619 | A | 4/1970 | Bishop | |
| 3,757,253 | A | 9/1973 | DeMarco | |
| 3,961,296 | A | 6/1976 | Wiggenhorn | |
| 4,028,643 | A | 6/1977 | Itoh | |
| 4,051,450 | A | 9/1977 | Barlow | |
| 4,129,839 | A | 12/1978 | Galani et al. | |
| 4,145,565 | A | 3/1979 | Donon | |
| 4,490,690 | A | 12/1984 | Suzuki | |
| 4,494,094 | A | 1/1985 | Spinner et al. | |
| 4,521,755 | A | 6/1985 | Carlson et al. | |
| 4,539,534 | A | 9/1985 | Hudspeth et al. | |
| 4,631,505 | A | 12/1986 | Schiavone | |
| 4,670,724 | A * | 6/1987 | Riblet et al. | 333/244 |
| 4,887,346 | A | 12/1989 | Bertalan | |
| 4,983,933 | A | 1/1991 | Volk et al. | |
| 5,561,405 | A * | 10/1996 | Hoffmeister et al. | 333/34 |
| 5,570,068 | A | 10/1996 | Quan | |
| 5,633,615 | A | 5/1997 | Quan | |
| 5,703,599 | A | 12/1997 | Quan et al. | |
| 5,712,607 | A | 1/1998 | Dittmer et al. | |
| 5,990,764 | A | 11/1999 | Tanizaki et al. | |
| 6,021,337 | A | 2/2000 | Remillard et al. | |
| 6,522,215 | B1 | 2/2003 | Enokuma | |
| 2004/0036560 | A1 | 2/2004 | Higuchi et al. | |

* cited by examiner

*Primary Examiner*—Stephen E. Jones
(74) *Attorney, Agent, or Firm*—Kolisch Hartwell, P.C.

(57) ABSTRACT

A circuit structure may include first and second transmission lines, each with a center conductor extending along or between one or more spaced-apart conducting surfaces. A conducting surface, such as a ground, reference, or signal-return plane, of the first transmission line may have an orientation that is transverse to the orientation of a conducting surface of the second transmission line. Each of the conducting surfaces of the first transmission line may contact one or more of the conducting surfaces of the second transmission line. In some examples, one or both of the transmission lines are slablines, and in some examples, the contacting edges or edges adjacent the contacting edges of the respective conductive surfaces are curved.

18 Claims, 4 Drawing Sheets

TRANSMISSION LINE ORIENTATION TRANSITION

RELATED APPLICATIONS

The present application claims priority from U.S. Provisional Patent Application Ser. No. 60/484,128, filed Jun. 30, 2003, incorporated herein by reference in its entirety for all purposes.

BACKGROUND

Transmission lines provide transmission of signals between circuits and circuit components at communication frequencies, such as radio frequencies (RF). Circuit components may have different positions and/or orientations in a circuit package or assembly of circuits. In order to provide continuous transmission lines between circuit components, then, it may be necessary to change the way that a transmission line is configured.

BRIEF SUMMARY OF THE DISCLOSURE

A circuit structure may include first and second transmission lines, each with a center conductor extending along or between one or more spaced-apart conducting surfaces. A conducting surface, such as a ground, reference or signal-return plane, of the first transmission line may have an orientation that is transverse to the orientation of a conducting surface of the second transmission line. Each of the conducting surfaces of the first transmission line may contact one or more of the conducting surfaces of the second transmission line. In some examples, one or both of the transmission lines are slablines, and in some examples, the contacting edges or edges adjacent the contacting edges of the respective conductive surfaces are curved.

BRIEF DESCRIPTION OF THE SEVERAL FIGURES

FIG. 1 an isometric view of an example of a transition in orientation of a slabline, in which a housing is shown with phantom lines, and solid structure in the housing is shown with solid lines.

DETAILED DESCRIPTION OF VARIOUS EMBODIMENTS

The figures illustrate different slabline transition embodiments. A slabline may include a transmission line having a round conductor between two extended parallel conducting surfaces. A strip line is a similar transmission line, in that it may include a strip or planar conductor between extended parallel conducting surfaces, or may include a strip conductor above an extended parallel conducting surface. An example of this latter form is a microstrip. Features discussed below relating to slablines may also be applied to such other forms of transmission line having one or more conducting surfaces relative to one or more signal or center conductors. Further, the conducting surface or surfaces may form a shield partially or completely surrounding one or more center conductors.

Figure 1:
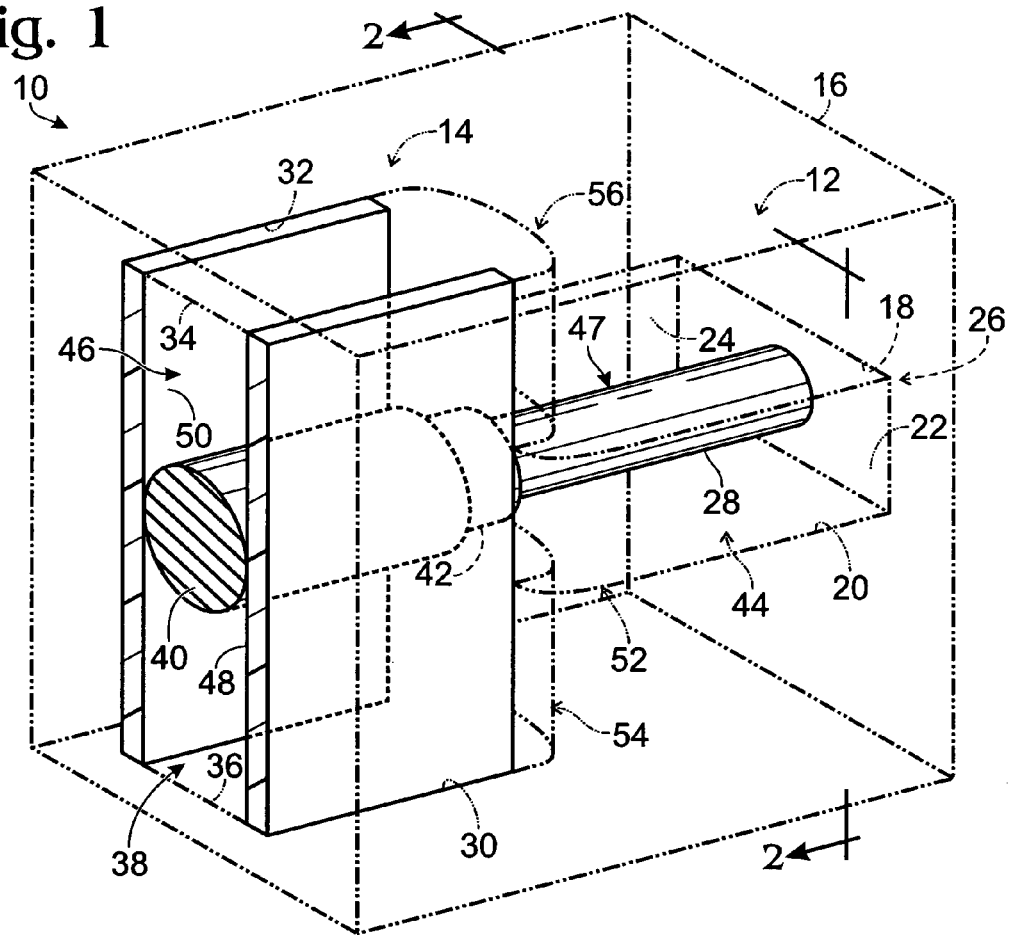
Figure 2:
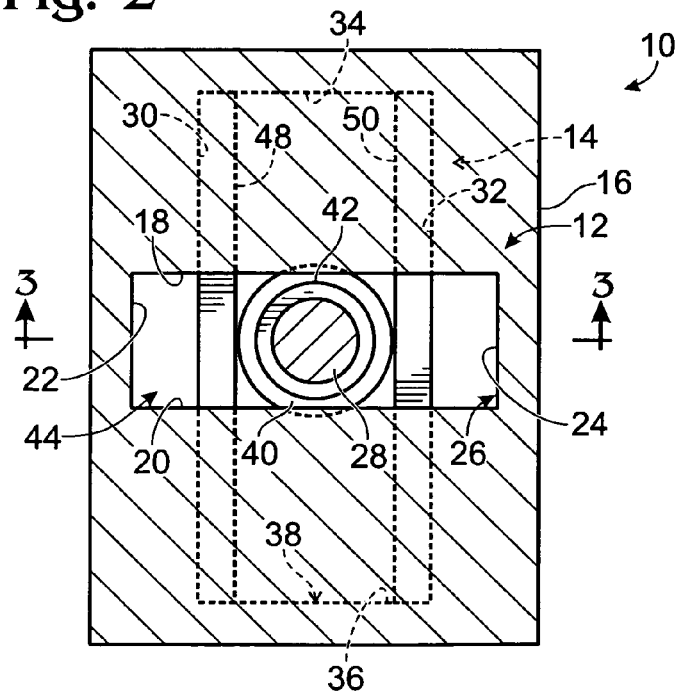
FIG. 2 is a cross section taken along line 2—2 in FIG. 1.
Figure 3:
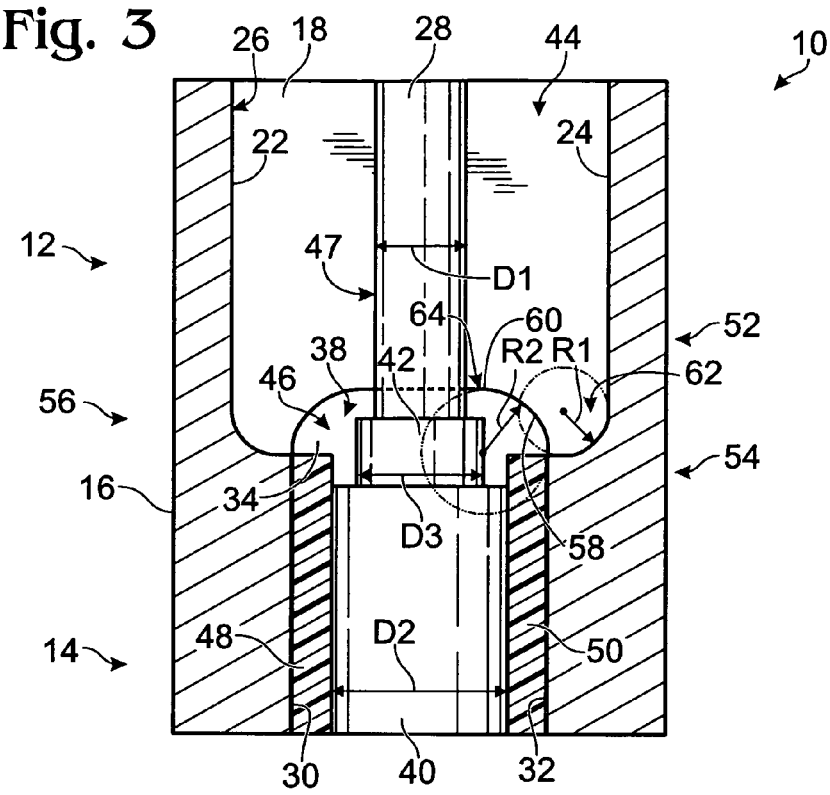
FIG. 3 is a cross section taken along line 3—3 in FIG. 2.
Figure 4:
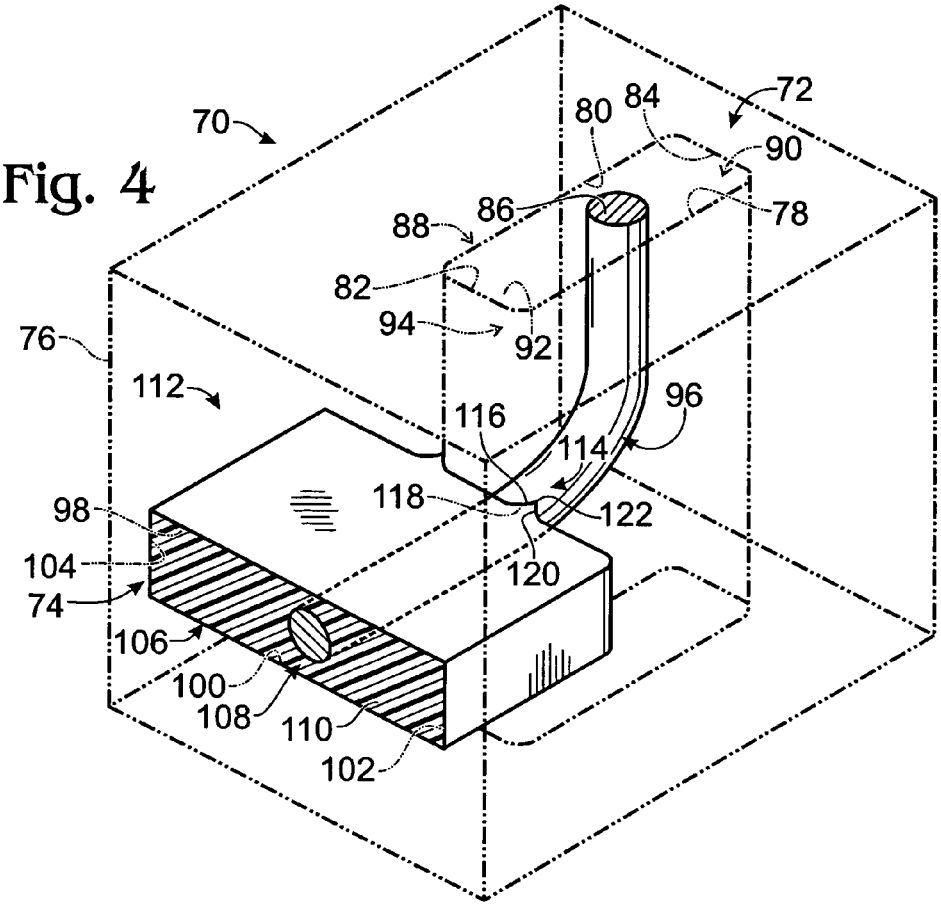
FIG. 4 is an isometric view of another example of a transition in orientation of a slabline, also in which a housing is shown with phantom lines, and solid structure in the housing is shown with solid lines.
Figure 5:
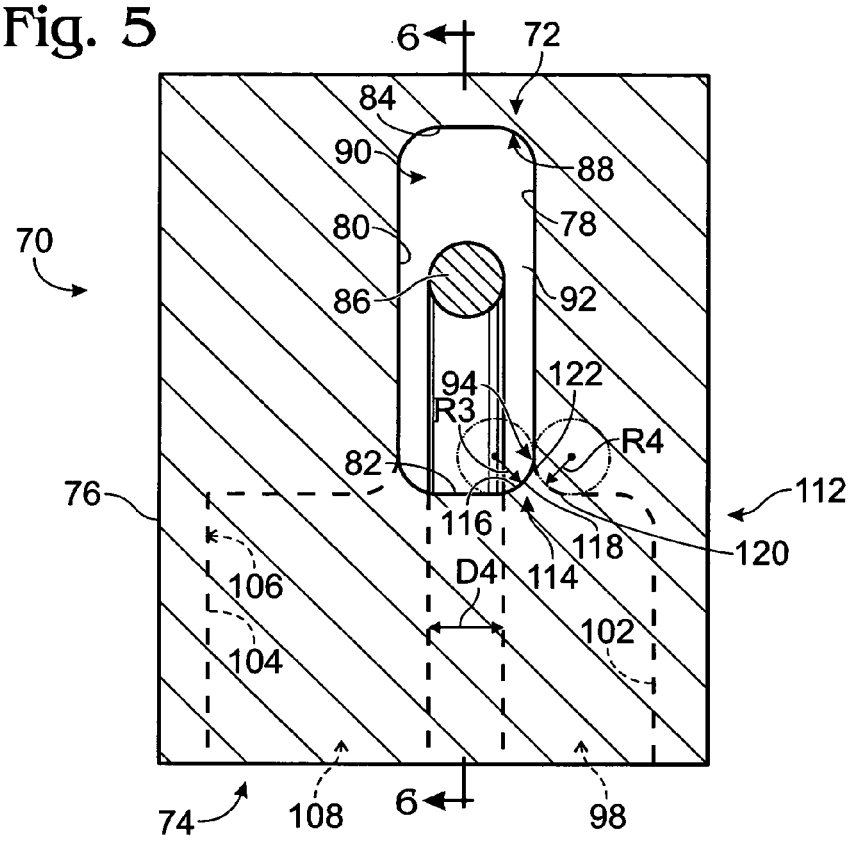
FIG. 5 is a cross-section represented by the top view of the transition shown in FIG. 4.
Figure 6:
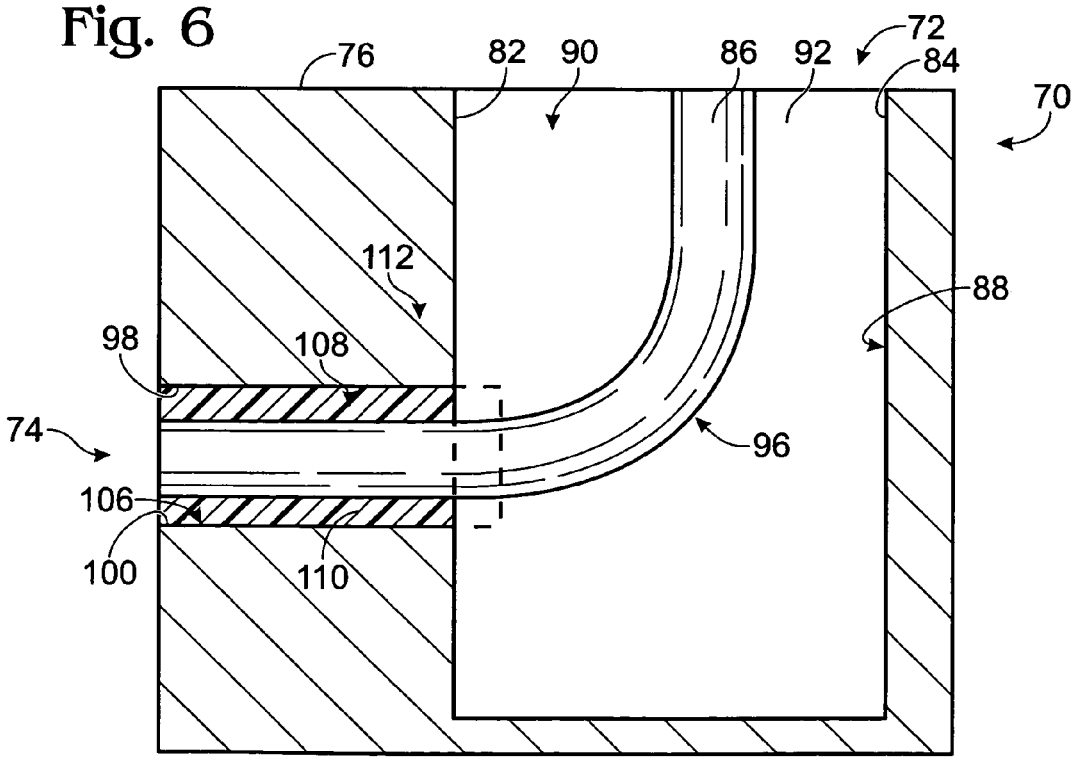
FIG. 6 is a cross-section taken along line 6—6 in FIG. 5.
Figure 7:
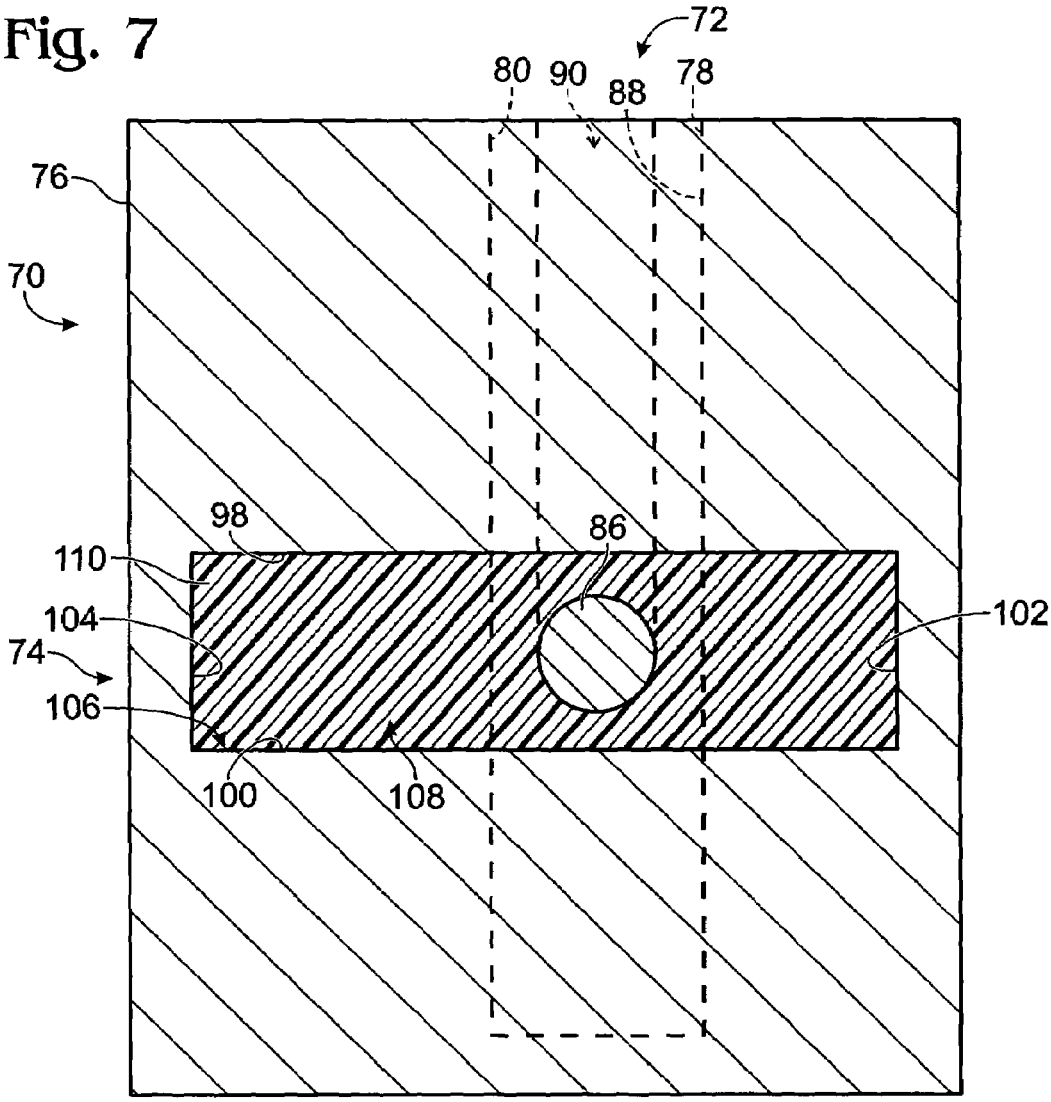
FIG. 7 is a cross-section represented by the view from the left of the transition shown in FIG. 6.

Referring then to a specific example, FIGS. 1–3 depict a circuit structure 10 in the form of a transmission line transition, including first and second transmission lines 12 and 14. In this example, the transmission lines are formed in a conductive housing 16 shown as a block of solid material. Housing 16 may also be formed in two or more parts that are held together by suitable attaching devices or materials, or may be formed as plates or layers on other substrates, and may be continuous or discontinuous, such as patterned or mesh-like in form, as appropriate to provide one or more effective Conducting surfaces. The conducting surface or surfaces may be planar, curved or irregular, depending on the application. In examples in which a plurality of conducting surfaces are included, the conducting surfaces may be parallel or non-parallel.

In the example at hand, transmission line 12 includes primary, extended opposite and parallel conducting surfaces 18 and 20, and secondary conducting surfaces 22 and 24. These conducting surfaces form a continuous shield 26 surrounding a center conductor 28 having a circular cross section with a diameter D1. In a slabline, the primary conducting surfaces may be longer or more extensive than the secondary surfaces. In a square-coaxial transmission line, however, all of the sides may have the same length.

Similarly, transmission line 14 includes primary, extended opposite and parallel conducting surfaces 30 and 32, and secondary conducting surfaces 34 and 36. These conducting surfaces form a continuous shield 38 surrounding a center conductor 40 having a circular cross section with a diameter D2, although a continuous shield is not required.

An intermediate conductor 42 connects conductor 28 to conductor 40. Conductor 42 has a diameter D3 intermediate in size between diameters D1 and D2. Conductor 42 extends partially into a cavity 44 defined by conducting surfaces 18, 20, 22 and 24 (shield 26), and partially into a cavity 46 defined by conducting surfaces 30, 32, 34 and 36 (shield 38). Conductors 28, 40 and 42 form a continuous conductor 47 extending through the transition between the transmission lines.

Cavities 44 and 46 may be filled by appropriate dielectric material, whether of solid, liquid or gas in form, or a combination of such materials. In this example, cavity 44 is shown filled with air, and cavity 46 is partially loaded, being filled with a combination of air and a solid dielectric. The solid dielectric in this example includes suitable dielectric plates 48 and 50 that extend between conductor 40 and conducting surfaces 30 and 32.

Transmission line 12 has an end 52 adjacent to a corresponding end 54 of transmission line 14. These ends form a transition 56 between the two transmission lines. Primary conducting surfaces 18 and 20 extend in a first orientation, such as generally horizontally as viewed in FIG. 1. Primary conducting surfaces 30 and 32 extend in a second orientation transverse to the orientation of conducting surfaces 18 and 20. In the example shown the primary conducting surfaces of transmission line 14 are generally orthogonal to the primary conducting surfaces of transmission line 12, with conducting surfaces 30 and 32 having a vertical orientation as viewed in FIG. 1, although other relative angles of orientation may be used.

Conducting surfaces 18 and 20 have respective edges that contact (transition into) respective edges of conducting surfaces 30 and 32. This transition is symmetrical about a plane passing through the center conductors, and parallel to conducting surfaces 18 and 20 or conducting surfaces 30 and 32. The transition between transmission lines 12 and 14 is described with regard to the structures of conducting surfaces 18 and 30, there being corresponding structure associated with each pair of intersecting conducting surfaces.

In other examples, a conducting surface of one transmission line may contact only one of the conducting surfaces of another transmission line. A transition between more than two transmission lines also may be provided.

Describing, then, a symmetrical portion of transition 56 between the transmission lines, conducting surface 18 contacts conducting surface 30 along a concave contacting edge 58. In the general sense, edge 58 is tapered rather forming a sharp corner, and in this example follows a curved line, as particularly shown in FIG. 3. In the example shown, contacting edge 58 has a radius of curvature R2 that corresponds in size to the size of the conductor adjacent to transition 56. In this case, radius R2 corresponds in size to intermediate conductor 42. More particularly, a radius of curvature of the edge that is greater than half the radius and less than twice the diameter of the adjacent conductor provides impedance matching at the transition. A radius of curvature of the edge that is substantially equal to the radius of curvature of the adjacent conductor may also be used.

Further impedance match in transition 56 may be realized by tapering or smoothing the edges of conducting surfaces where the transition involves changing a dimension of the respective conducting surfaces. For example, in transition 56, relatively widely spaced-apart secondary conducting surfaces 22 and 24 narrow down to the more narrow spacing of primary conducting surfaces 30 and 32. This narrowing may be accomplished by tapered secondary conducting surfaces, such as tapered surface portion 22*a*. Correspondingly, edges of the primary conducting surfaces 18 and 20, such as edge 60 of conducting surface 18, may generally conform to the form of secondary surface portions, such as surface portion 22*a*. Again, this tapering may be in the form of curved surfaces and edges that may have a radius of curvature, such as a radius R1 shown in FIG. 3. These curved surfaces and edges thus provide rounded corners, such as corner 62, for the transmission line ends and cavities, such as end 52 and cavity 46. Similarly, transmission line end 54, including the associated end of cavity 46, has rounded corners, such as corner 64 having a radius of curvature R2 corresponding to the diameter D3 of intermediate conductor 42.

FIGS. 4–7 illustrate a transmission line transition circuit structure 70, including first and second slabline transmission lines 72 and 74 formed in a suitable structure, such as a conductive housing 76. Transmission line 72 includes primary conducting surfaces 78 and 80, secondary conducting surfaces 82 and 84, and a center conductor 86. Center conductor 86 may have a circular cross section, as shown, with a width or diameter D4. Conducting surfaces 78, 80, 82 and 84 define a shield 88 forming a cavity 90. Cavity 90 may be filled with a suitable dielectric, such as air dielectric 92. As has been explained, dielectric 92 may be a gas, liquid or solid substance, or a combination of such substances. As particularly shown in FIGS. 4 and 5, shield 86 has tapered corners, such as corner 94 having a concave curvature with a radius of curvature, R3, that corresponds to the radius of curvature of conductor 86.

Center conductor 86 has a bend 96 of 90°, passing through secondary conducting surface 82 and into transmission line 74, in which it is also the center conductor. Transmission line 74 includes primary conducting surfaces 98 and 100, and secondary conducting surfaces 102 and 104, which conducting surfaces collectively form a shield 106 surrounding a cavity 108 containing center conductor 86. As with cavity 90, cavity 108 may be filled with a suitable dielectric, such as solid dielectric 110.

An end 112 of transmission line 74 abuts transmission line 72 with edges of primary conducting surfaces 98 and 100 contacting edges of secondary conducting surface 82. More particularly, conducting surfaces 98 and 100 have extensions that matingly contact an edge of conductive surface 82. For example, an extension 114 of surface 98 includes a concave edge 116 that conforms to and contacts an edge 118 of surface 82. Edges 116 and 118 form a curve with a radius of curvature R3. Each extension also has a concave edge, such as edge 120 of extension 114, that meets the opposite edge, such as edge 118, at a point, such as point 122, and provides for a smooth edge transition between primary conductive surfaces 78 and 98. Edge 120 forms a curve with a radius of curvature R4 that in this example is equal to R3.

FIGS. 1–7 thus illustrate transitions in which the orientation of a conducting surface of a transmission line are changed. These transitions are described as junctions between two transmission lines, and may also be considered the same as a transition in a transmission line having transmission line portions. Although shown in these examples as slabline transitions in a continuous conductive housing forming a shield around a center conductor, the transitions may also be used on other forms of transmission line structures including or not including secondary conducting surfaces.

Accordingly, while embodiments have been particularly shown and described with reference to the foregoing disclosure, many variations may be made therein. The foregoing embodiments are illustrative, and no single feature or element is essential to all possible combinations that may be used in a particular application. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate or imply a required or limited number of such elements, and do not indicate a particular position or order of such elements unless otherwise specifically stated.

INDUSTRIAL APPLICABILITY

The methods and apparatus described in the present disclosure are applicable to the telecommunications and other communication frequency signal processing industries involving the transmission of signals between circuits or circuit components.

The invention claimed is:

1. A circuit structure comprising:

a first transmission line having a first center conductor extending between first and second spaced-apart, planar primary conducting surfaces having widths that are greater than a distance between the first and second conducting surfaces, and the first and second conducting surfaces having a first orientation; and a second transmission line having a second center conductor having an end coupled to an end of the first center conductor, the second center conductor extending between third and fourth spaced-apart, planar primary conducting surfaces having widths that are greater than a distance between the third and fourth conducting surfaces, the third and fourth conducting surfaces having a second orientation transverse to the first orientation, the third conducting surface contacting at least the first conducting surface and the fourth conducting surface contacting at least the second conducting surface.

2. The circuit structure of claim 1, of which the first orientation is substantially orthogonal to the second orientation.

3. The circuit structure of claim 1, of which the first center conductor includes a bend adjacent to the end of the first center conductor.

4. The circuit structure of claim 3, of which the bend extends generally parallel to the first and second surfaces.

5. The circuit structure of claim 1, of which the first and second center conductors are of different sizes.

6. The circuit structure of claim 5, further comprising an intermediate center conductor connecting the first and second center conductors, the intermediate center conductor having a size intermediate the sizes of the first and second center conductors.

7. The circuit structure of claim 1, of which the third and fourth conducting surfaces each contact both of the first and second conducting surfaces.

8. The circuit structure of claim 7, of which the first and second conducting surfaces have edges that taper inwardly adjacent to where the first and second conducting surfaces contact the third and fourth conducting surfaces.

9. The circuit structure of claim 8, of which the tapered edges of the first and second surfaces are curved.

10. The circuit structure of claim 9, of which at least a portion of each of the tapered edges of the first and second surfaces is curved with a substantially constant radius of curvature.

11. The circuit structure of claim 10, of which the first center conductor has a cross section with a first width, and the radius of curvature of each of the tapered outer edges has a radius of curvature that is less than twice the first width of the first center conductor.

12. The circuit structure of claim 10, of which the first center conductor has a generally circular cross section with a first radius of curvature, and the radius of curvature of each of the tapered outer edges generally equals the first radius of curvature.

13. The circuit structure of claim 12, of which the second center conductor has a generally circular cross section with a second radius of curvature, and the third and fourth conducting surfaces have edges that contact corresponding edges of the first and second conducting surfaces, forming respective pairs of contacting edges that are curved with a radius of curvature that corresponds to the radius of curvature of the center conductor adjacent to the contacting edges.

14. The circuit structure of claim 13, of which the first and second conducting surfaces have curved non-contacting edges adjacent the contacting edges.

15. The circuit structure of claim 14, of which the non-contacting edges are either concave or convex.

16. The circuit structure of claim 15, of which the non-contacting edges have radii of curvature corresponding to the radius of curvature of the first center conductor.

17. The circuit structure of claim 13, of which the pairs of contacting edges are curved with a radius of curvature that is generally equal to the radius of curvature of the center conductor adjacent to the contacting edges.

18. A circuit structure comprising:

a first slabline having a first center conductor extending through a shield having first and second spaced-apart, parallel and planar primary conducting surfaces having widths that are greater than a distance between the first and second conducting surfaces, the first center conductor having a circular cross section with a radius and the first and second conducting surfaces having a first orientation; and a second slabline having a second center conductor having an end coupled to an end of the first center conductor, the second center conductor extending through a shield having third and fourth spaced-apart, parallel and planar primary conducting surfaces having widths that are greater than a distance between the third and fourth conducting surfaces, the third and fourth conducting surfaces having a second orientation substantially orthogonal to the first orientation, the third and fourth conducting surfaces having respective edges each contacting edges of the first and second conducting surfaces and forming respective pairs of contacting edges, each pair of contacting edges being matingly curved with a radius of curvature that is between one-half and two times the radius of the center conductor adjacent to the contacting edges.

* * * * *